US005592034A

United States Patent [19]

Felmus et al.

[11] Patent Number: 5,592,034

[45] Date of Patent: Jan. 7, 1997

[54] POWER SHUT DOWN DELAY CIRCUIT FOR A POSTAGE METER MAILING MACHINE HAVING AN INK JET PRINTER SYSTEM

[75] Inventors: Benita J. Felmus, Westport; Edilberto I. Salazar, Brookfield; Richard P. Schoonmaker, Wilton, all of Conn.

[73] Assignee: Pitney Bowes Inc., Stamford, Conn.

[21] Appl. No.: 581,718

[22] Filed: Dec. 29, 1995

[51] Int. Cl.[6] ..... H01H 35/00

[52] U.S. Cl. ..... 307/130; 307/125; 347/1; 347/22; 347/23; 395/114; 209/900; 346/141; 101/2

[58] Field of Search ..... 307/130, 125; 347/1, 22, 23; 395/114; 209/900; 355/296; 346/141; 101/2

[56] References Cited

U.S. PATENT DOCUMENTS

| | | | |
|---|---|---|---|
| 4,240,082 | 12/1980 | Yu | 346/75 |
| 4,399,538 | 8/1983 | Cholakian et al. | 371/66 |
| 4,422,080 | 12/1983 | Titcomb | 346/1.1 |
| 4,470,693 | 9/1984 | Dolan | 355/15 |
| 4,558,332 | 12/1985 | Takahashi | 346/140 R |
| 4,578,758 | 3/1986 | Muller | 364/466 |
| 4,706,159 | 11/1987 | Hafner | 361/93 |
| 5,188,025 | 2/1993 | Murphy, III et al. | 101/91 |
| 5,321,436 | 6/1994 | Herbert | 346/140 R |
| 5,329,293 | 7/1994 | Liker | 347/11 |
| 5,416,572 | 5/1995 | Kolb et al. | 355/299 |
| 5,434,605 | 7/1995 | Osborne | 347/23 |
| 5,517,218 | 5/1996 | Lehna et al. | 347/24 |

*Primary Examiner*—William M. Shoop, Jr.
*Assistant Examiner*—Albert W. Paladini
*Attorney, Agent, or Firm*—Angelo N. Chaclas; Melvin J. Scolnick

[57] ABSTRACT

A mailing machine includes a digital printer for printing a postage indicia on a mail piece. The mailing machine including a controller for controlling the operations of the mailing machine and a printer transport for transporting the digital printer to a cleaning station when the printer is not in use. A sensor is positioned at the cleaning station for sensing the presents of the printer and generating an output to the mailing machine controller in response. The mailing machine power supply includes a main transformer and a plurality of secondary transformer in parallel electrical communication over first and second electrical lines. A single-pole-double-throw switch has its first input and output stage interposed between the first electrical line between the main transformer and one of the second transformers. The second input and output stage of the switch is in electronic communication with the mailing machine controller such that when the switch is open a first voltage level is received by the mailing machine controller and when the switch means is closed a second voltage level is received by the mailing machine controller. The switch provides an electrical by-pass alone the first electrical line around the first input and output stage of the switch when the switch is open unexpectedly by an operator. A by-pass gate responses to the initial opening of the DPST switch to provide a power by-pass until the mailing machine controller is informed that the printer is properly positioned in the cleaning station.

5 Claims, 3 Drawing Sheets

POWER SHUT DOWN DELAY CIRCUIT FOR A POSTAGE METER MAILING MACHINE HAVING AN INK JET PRINTER SYSTEM

BACKGROUND OF THE INVENTION

The present invention relates to a postage metering system which employs an ink jet printer for printing of the postage indicia on a mail piece.

Generally, one type of postage meter mailing machine system includes a base commonly referred to as a mailing machine. The mailing machine operates under the control of a microcontrol system which is responsible for controlling a number of mail delivery function, such as, singulation and sealing. The mailing machine may also include a user interface for providing user functions, such as, department accounting, and an number input-output interfaces for permitting communication with external devices, such as, a personal computer and printer. Conventional, a power supply is provided in the mailing machine from which power is distributed to various other units attached to the mailing machine.

It is known to detachably mount a secure meter vault to the mailing machine for keeping track of critical funds accounting data and assuring that such funds are accurately accounted for prior to enabling printing of a postage indicia representing a sum certain in expended postage. In order to provide secure funds accounting, that is, to assure that what is printed is actually accounted for by the meter vault, a intelligent digital printer is employed wherein information pass between the meter vault and the digital printer can be communicated in encrypted form. It is equally important to the customer that fund which are accounted for by the meter vault are actually printed.

Wherein the digital printer employs ink jet technologies, it is important to maintain a cleaning station to assure that the ink jet nozzles are protected from clogging. It is noted that should a mail run be initiated and the ink jet nozzles are not functioning properly, the user stands to lose the corresponding postage funds due to improperly printed or non-printing of the postage indicia. Therefore, when the mailing machine is not in use, it is advantageous to provide the mailing machine with a suitable positioning mechanism to place the printer in contact with the cleaning station to prevent exposure of the printer ink jet nozzles to ambient condition thereby deterring nozzle clogging. Consequently, it is important that it is consider important to provide adequate measure which assure that the printer is residing at the cleaning station when not in use.

SUMMARY OF THE INVENTION

It is an object of the present invention to present a mailing machine system which prevents the premature disruption of power to the positioning drive motors during a power down cycle of the mailing machine.

A postage meter system in accordance with the present invention includes a mailing machine, which serves as a platform for the meter vault. The mailing includes a microcontroller system which is responsible for controlling a number of system operations, such as, transportation of envelopes in a sequential manner to a printing location and, subsequent to printing, ejecting the envelope from the printing location to a stacking device. In the preferred embodiment of the mailing machine, there is included a feeder section for receiving a stack of envelopes and presenting a plurality of the envelopes from the stack to a singulation station. The singulation station is responsible for withdrawing a single envelope from an envelopes presented in a seriatim manner. The envelope is then transported to a integrated scale whereat the envelope may be weighed. The envelope is then presented to the printing station whereat an ink jet printer can print a postage indicia and other additional information, such as, an ad slogan, delivery address or bar code on the envelope. In a preferred configuration, it is contemplated that printing will accrue during relative motion between the envelope and a ink jet printer. The mailing machine also includes a power supply from which power is distributed to various other subsystems, such as, user interface, meter vault and printer.

In order to prevent the user from shutting off power to the mailing machine before the printer has been positioned at the printing station, an AC switch is placed in parallel with the mailing machine power switch. The power switch is a single-pole-double-throw (DPST) switch. One pole of the DPST switch is used to switch the AC line to the power transformer while the other pole generates a logic level signal used to inform the main control logic that the power switch has been turned off.

DETAILED DESCRIPTION OF THE PREFERRED EMBODIMENT

Figure 1:
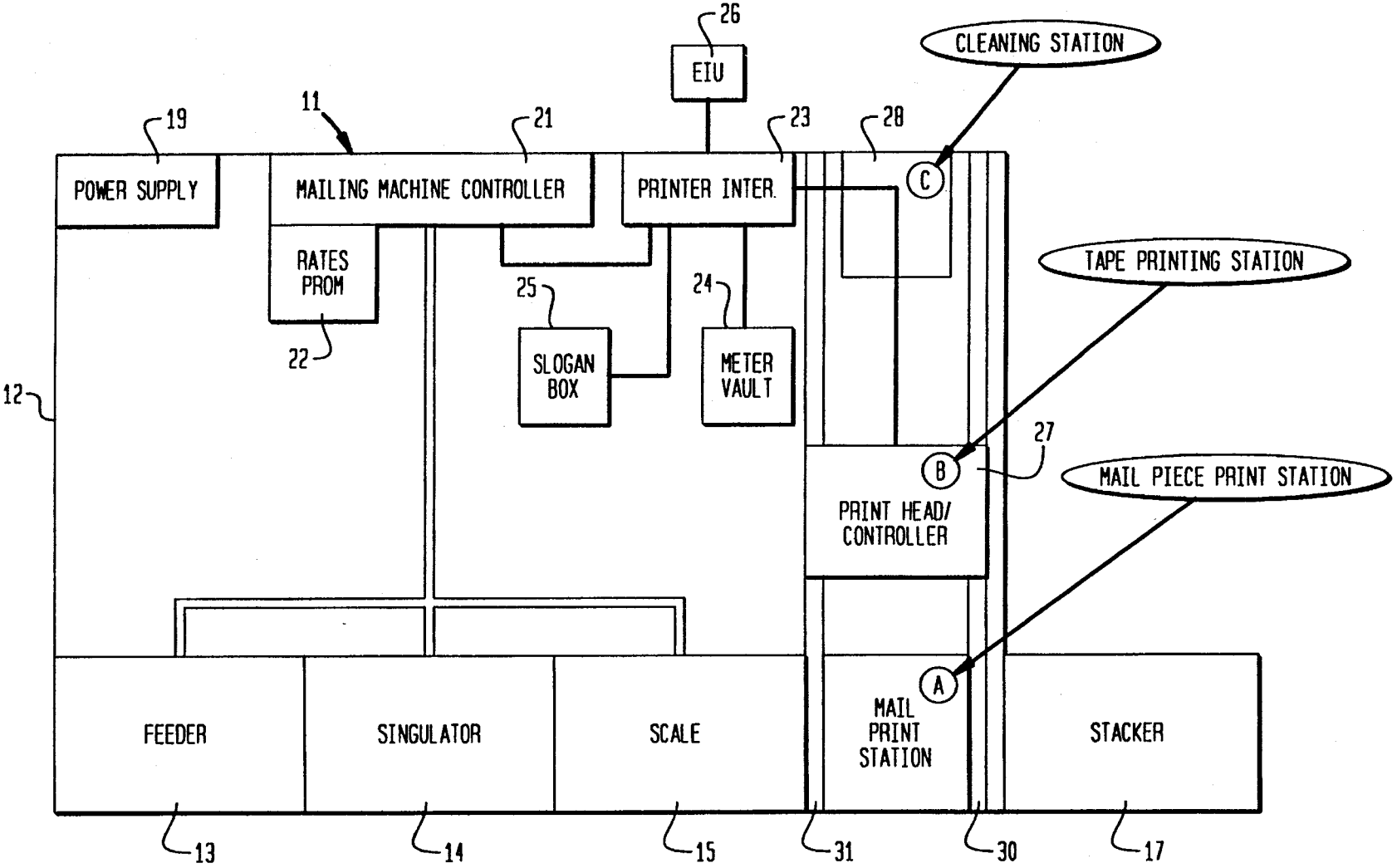
FIG. 1 is schematic of a mail processing system in accordance with the present invention.

Referring to FIG. 1, the postage meter system, generally indicated as 11, includes a mailing machine base 12. The mailing machine base 12 is of any suitable known design and, in the preferred embodiment, includes a feeder section 13, singulator 14 and scale section 15 positioned serially along a mail flow path. Following the scale section 15 is a print station at location A which is followed by a stacker 17. Any suitably designed feeder section 13, singulator section 14, scale section 15 and stacker section 17 may be used. The operation of the respective section 13, 14, 15, and 17 is under the control of a mailing machine controller 21. Power to the system is provided by a conventional power supply 19. It should be appreciated that the mailing machine microcontroller, generally indicated as is responsible for providing real time motor control function to the respective sections 13, 14, 15, and 17, in addition to, non-real time control for such machine functions as keyboard and display, unsecured departmental accounting (not shown) and external communications. As depicted in FIG. 1, a rates programmable read only memory (PROM 22) is detachable mounted to the mailing machine controller 21 to provide rate information to the mailing machine controller in any suitable conventional manner.

Also, housed in the mailing machine is a printer interface 23, graphics interface 25, meter vault 24 and print head/controller 27, hereafter referred to as print head 27. The print head 27 is mounted to a rails 30 and 31 by any suitable means to be positionable, by any convention means such as by a motor (not shown) between a first position "A" which is the print position, a second position "B" which is a tape print position, and a third position "C" which is a cleaning position. At position "C" the print head 27 is brought into contact with a nozzle cleaning system of any suitable design such that, for example, wherein ink jet print technology is utilized by the print head 27, the nozzles may by cleaned. The positioning of the print head 27 along the rails 30 and 31 is under the control of the mailing machine controller utilizing any suitable conventional control means.

Also, the mailing machine 12 includes provisions for allowing the external interface of a external interface unit (EIU 26) to the printer interface 23 by any conventional means. The EIU 26 provides addition microprocessor functionality to the system 11 utilizing any suitable method.

Figure 2:
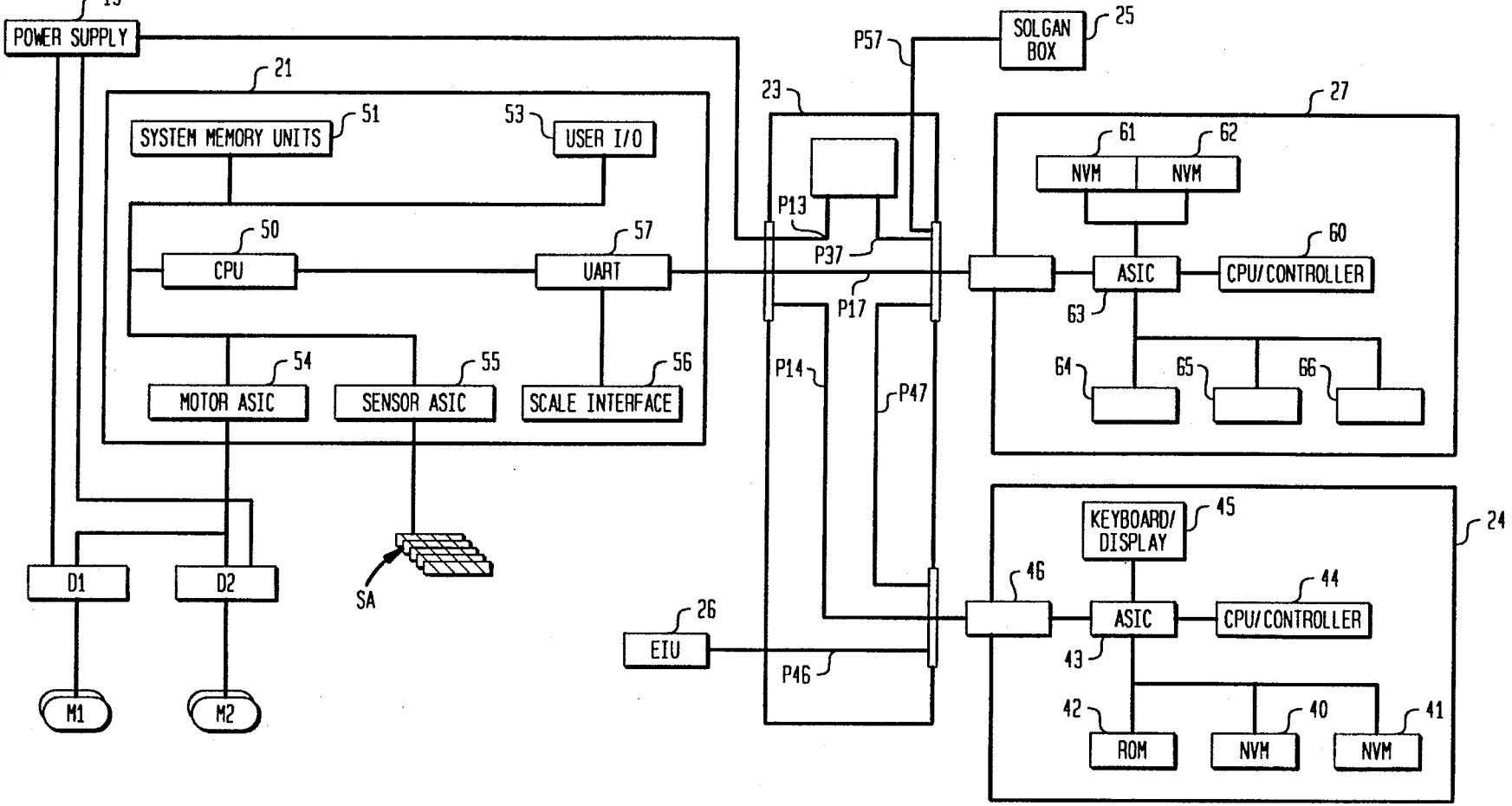
FIG. 2 is a schematic of the microcontrol system for a mailing machine in accordance with the present invention in combination with a meter vault, printer interface and printer particularly suited to the present invention.

Referring to FIG. 2, the meter vault 24 includes a source accounting memory 40 and 41, program memory 42, application specific integrated circuit (ASIC) 43, CPU controller 44, and keyboard/display 45. The ASIC 43 provides a two RS-232 communications port 46 for facilitating communications with the mailing machine 21.

The communication port 46 is modified to include an extra pin for receiving DC power from the mailing machine. It should be appreciated that the keyboard and display 45 is provides an operator or postal agent a means of recharging the accounting registers of the accounting memory 40 and 41 through the keyboard in any suitable conventional manner.

The mailing machine controller 21, among other things, includes of a controller CPU 50, system memory units, generally indicated as 54, user input/output 53, motor control ASIC 54, sensor control ASIC 55. The motor control ASIC 54 is in control communication with motor drivers D1 and D2. Motor driver D1 gates driving current from the power supply 19 to a motor M1. The motor M1 is provided to supply the drive force intended for any suitable mechanism to position the print head and controller along the rails 30 and 31 in position A, B and C. In like manner, motor driver D2 gates driving current from the power supply 19 to a motor M2. The motor M2 is provided to supply the drive force required by other mailing machine 21 units, such as, the feeder 13 and singulator 14. The Sensor ASIC is in electronic communication with sensor bank SA which is positioned in various location through the mailing machine.

Also, provided is a scale interface 56 and UART interface 57. The UART interface 57 is of any conventional design for allowing asynchronies serial communication. The UART interface facilitating communication between the mailing machine controller 21 and the other system units 23, 24, 25, 26 and 27.

The print head 27 is comprised of a CPU controller 60, nonvolatile memory units 61 and 62, ASIC 63 and print units 64, 65, 66. The are ink jet printing units.

Meter vault 24 communications to the print head 27 are routed through the printer interface 23 along communication path P47. The meter vault 24 securely communicates with the print head 27 using DES encryption. A number of encryption keys are preloaded into the ASIC's 63 of the print head 27 and ASIC 43 of the meter vault 24. This will make discovering the keys impossible without reverse engineering of the ASIC's 43 or 63. Communications path 47 is also used to select inscriptions and slogans in conjunction with the graphics interface 25. A printer interface path P46 provided for electrical communication with the EIU 26. As aforenoted, the EIU 26 represents an external unit which can be attached to the meter vault 24 to provide enhanced capability to the meter vault 24 when the meter vault 13 is used in combination with a de-featured mailing machine.

The printer interface 23 serves as a junction board for the mailing machine 21, meter vault 24, print head 27 and a graphics interface 25. By providing specific communication path P13, P14, P17, P37, P46, P47, P57 within the printer interface 23, the individual subsystems can be isolated in such a manner to remove the necessity for interdependent security measures.

The graphics interface 25 stores graphics images representing the fixed part of the standard indicia (e.g., the eagle printed on U.S. mail), low-value indicia, permit mail indicia, town circle (where appropriate), inscriptions, and slogans. It also stores the fonts for printing the variable data on the mail piece. All of the graphics data is either encrypted or signed in the graphics interface 25 non-volatile memory (not shown). Only the print head 15 contains the necessary decryption key to properly interpret the data. Because of the different indicia formats, each country will have its own indicia graphics, therefore its own graphics interface 27 product code number.

The print head 27 prints the indicia including postage amount, digital tokens, piece count, and date as well as an optional inscription and slogan on each mail piece. The fixed part of the image, fonts for the variable parts of the image, and inscription bit-maps are programmed into the print head's NVM 61 and 62 when the print head is first installed in the mailing machine 17. The meter vault 24 will send a message to the print head indicating the format of the town circle. The print head obtains the town circle information as either a text string from the meter vault or a bit map from the graphics interface and programs its NVM with the data. For each mail piece, the meter vault 24 transfers the variable indicia information such as the postage amount, digital tokens, meter serial number, and piece count to the print head. The print head controller 60 programs registers (not shown) in the ASIC 63 with this information. When the mailing machine 21 commands the print head to print, the ASIC 63 combines the fixed and variable parts of the image for printing by the print units 64, 65 and 66 utilizing any suitable technique.

The interface with the meter vault 24 includes encrypted information; only the meter vault 24 and the print head 27 know the proper keys to utilize the information. The keys are stored in an ASIC 63 on the print head 27 and the meter vault ASIC 43.

The controller 60 on the print head controls the printing operation including loading of NVM 61 and 62, decoding of messages and initiating of printing. The print head ASIC 63 also decodes the mail position for printer sequencing, provides the proper timing for driving the print nozzles, supports external ink supply monitoring, interfaces to the NVM 61 and 62; supports external communications, and performs self-test functions. The print head NVM 61 and 62 also stores inscription representations. The meter vault 24 stores a table of enabled inscriptions when the operator at the mailing machine 21 wishes to select an inscription, the print head transfers a list of the available options to the meter vault. The vault screens for only the enabled inscriptions and sends the information to the mailing machine 21. The operator response is forwarded from the meter vault 24 to the print head 27.

Figure 3:
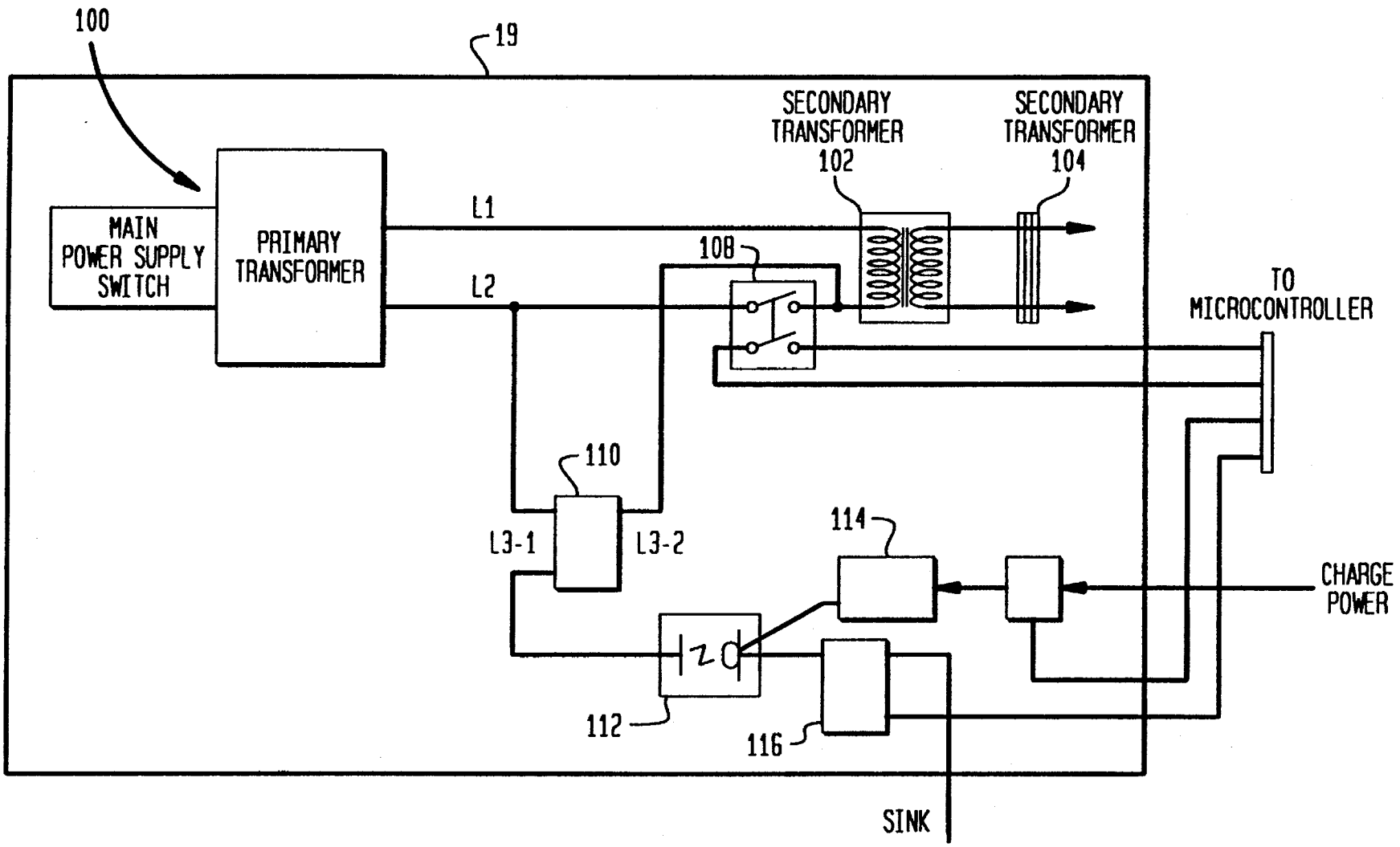
FIG. 3 is a schematic of the mailing machine delayed power down system in accordance with the present invention.

Referring now more particularly to FIG. 3, the power supply 19 is comprised of a conventional primary transformer and main power switch 100. The first output line L1 of the primary transformer 100 is directed to the input of a secondary transformer 102. The second output line L2 is directed to the first input of a DPST switch 108. The first output of the DPST switch 108 is directed to the other input of the transformer 102. Intersecting L2 in advance of the input side of DPST switch 108, at one is a by-pass line L3. The other end of by-pass line L3 intersects L2 along the output side of the DPST switch 108. The second input and output of the DPST are in electronic communication with the microcontroller 21 such that a reference voltage is applied directed to the second input, thereby allowing the microcontroller 21 to be informed of the status of the DPST switch. The by-pass line L3 is intercepted by a gate 110 having a first state to allow current flow through L3 and a second state blocking current through L3. The state of gate 110 is responsive to the output of a optical coupler 112. A suitable charge device 114 is tied to the input side of the optical coupler 112. The control line of the optical coupler 112 is tied to the state of a gate 116 which is subject to control signals from the microcontroller 21.

It should now be appreciated that when the operator manually opens the DPST switch 108, the microcontroller 21 is informed. The microcontroller 21 then enables gate 116 to allow the optical coupler 112 to drive the gate 110 enabled. By enabling gate 110, power form the primary transformer 100 is diverted around the DPST switch 108 for such time as the microcontroller holds gate 116 enabled. During such time, power can continue to be supplied to the motor M1 to drive the printer 27 to position C and thereby into contact with the cleaning station. After this process is complete the microcontroller 21 releases the gate 116 which result in disruption of the signal to gate 110 and system power shut-down.

What is claimed is:

1. An improved mailing machine for a postage meter mailing system, said postage meter mailing system having a meter vault including a controller, said controller of said meter vault having a communication port for receiving and transmitting data messages and for storing funds accounting data a digital printer including a controller for controlling printing of said digital printer, said controller of said printer having a communication port for receiving and transmitting data messages, a mailing machine including a controller for controlling operations of said mailing machine and having a communication port for receiving and transmitting data messages, a cleaning station, a printer transport for transporting said digital printer to and from said cleaning station, a printer interface means for providing a communication path between said mailing machine, meter vault and said printer, wherein said improved mailing machine comprising:

sensor means for sensing the presents of said printer at said cleaning station and generating an output to said mailing machine controller in response, a power supply having a main transformer and a plurality of secondary transformer in parallel electrical communication over first and second electrical lines, a switch means having a first input and output stage and a second input and output stage, said first input and output stage interposed between said first electrical line between said main transformer and one of said second transformers, said second input and output stage being in electronic communication with said mailing machine controller such that when said switch means is open a first voltage level is received by said mailing machine controller and when said switch means is closed a second voltage level is received by said mailing machine controller, by-pass means having a first mode for providing an electrical by-pass alone said first electrical line around said first input and output stage of said switch when said switch means is open, and a second mode for preventing electrical by-pass alone said first electrical line when said switch means is closed, means for placing said by-pass means in said second mode in response to initial opening of said switch means until said printer is positioned in said cleaning station and then causing said switch means to close.

2. An improved mailing machine as claimed in claim 1 wherein said means for placing said by-pass means in said second mode comprising, said mailing machine controller being responsive to second voltage lever to generate a first control signal, latch means for latching said by-pass means in said first mode in response to said first control signal, said mailing machine controller being further responsive to said output of said sensor for releasing said latching means.

3. An improved mailing machine as claimed in claim 2 wherein said switch means is a DPST switch.

4. An improved mailing machine as claimed in claim 3 wherein said by-pass means comprises a gate having an input in electrical communication with said first electrical line between said primary transformer and said DPST switch and a output in electrical communication with said first electrical line between said DPST switch and said secondary transformer, said first mode of said gate being closed to providing an electrical by-pass alone said first electrical line around said first input and output stage of said DPST switch when said switch means and said second mode being open for preventing electrical by-pass alone said first electrical line.

5. An improved mailing machine as claimed in claim 4 wherein said means for placing said gate in said second mode in response to said printer being positioned in said cleaning station comprising:

an optical coupler being enable by said control signal from said mailing machine controller to generate a control voltage, said gate being responsive to said control voltage to assume said second mode.

* * * * *